US006394421B1

(12) United States Patent
Henly

(10) Patent No.: US 6,394,421 B1
(45) Date of Patent: May 28, 2002

(54) WINDLASS ASSEMBLY

(75) Inventor: Nicholas Charles Henly, Petersfield (GB)

(73) Assignee: Lewmar Limited, Hampshire (GB)

( * ) Notice: Subject to any disclaimer, the term of this patent is extended or adjusted under 35 U.S.C. 154(b) by 0 days.

(21) Appl. No.: 09/578,860

(22) Filed: May 26, 2000

(30) Foreign Application Priority Data

Jun. 16, 1999 (GB) ..... 9914084

(51) Int. Cl.[7] ..... B66D 1/14
(52) U.S. Cl. ..... 254/365; 254/374
(58) Field of Search ..... 254/278, 294, 254/364, 365, 366, 368, 374, 383

(56) References Cited

U.S. PATENT DOCUMENTS 398,502 A * 2/1889 Dyblie et al. ..... 254/278
644,468 A * 2/1900 Rutter ..... 254/365
2,526,525 A * 10/1950 Young ..... 254/365
2,705,126 A * 3/1955 Addicks ..... 254/365
2,857,028 A * 10/1958 Brooks ..... 254/365
2,922,624 A * 1/1960 Addicks ..... 254/365
4,913,076 A 4/1990 Norton ..... 114/210
5,314,166 A 5/1994 Muir

FOREIGN PATENT DOCUMENTS

WO WO 96/09980 4/1996

* cited by examiner

*Primary Examiner*—Emmanuel M. Marcelo
(74) *Attorney, Agent, or Firm*—Burns, Doane, Swecker & Mathis, L.L.P.

(57) ABSTRACT

A windlass assembly includes a single-turn gypsy for engaging the line and/or chain of an anchor rode of a water craft. This has to be driven from a drive shaft, but also has to have the capacity to rotate relative to the shaft under the influence of the anchor as it is paid out. A lever is movable between positions where it engages drive to and disengages drive from the gypsy. It is biased (e.g. by a spring) towards the engaged position, but in its other position can be pressed onto the gypsy to control the friction to which the latter is subject while rotating relative to the shaft.

9 Claims, 6 Drawing Sheets

132
133
134
129
131
116
122
128
128
127
121
114
125
120
117
115
130
101
106
103
105
109
107
100
127
102
104

WINDLASS ASSEMBLY

The invention relates to a improved windlass assembly for water craft.

A form of windlass having a gypsy (in which a line and/or chain executes only a single turn between inward and outward runs)is commonly used in marine craft to haul and veer the anchor rode i.e. the line and/or chain to which the anchor is attached. When the anchor is dropped, it is desirable that the anchor rode can pay out freely under the weight of the anchor. A free fall mode allows the gypsy to rotate freely. However, to haul in the anchor, the drive mechanism of the windlass must engage the gypsy, which can then rotate to wind in the anchor rode.

There are several problems with this type of windlass. Often after the anchor rode has been paid out and the anchor dropped, the windlass is inadvertently left in the free fall mode. This is a particular problem if the craft stays at anchor for a period of time, because the mode of the windlass is frequently forgotten. Because the drive mechanism is not engaged, subsequent operation of the windlass will not haul the anchor rode.

If the windlass has been insufficiently tightened or has worked loose during a passage, it is possible for the anchor to fall overboard under its own weight and drag out the anchor rode after itself. This can be particularly dangerous if the boat is travelling at high speed.

The present invention provides a windlass which overcomes these problems by providing a means for controlling the 'free fall' of the anchor rode and a locking system which prevents inadvertent free fall and invariably allows the anchor rode to be hauled at will.

One aspect of the present invention is a windlass having a rotatable central drive shaft adapted to rotate a gypsy, a locking lever, the locking lever being mounted so as be movable between a first position in which the gypsy is coupled to the drive shaft and a second position in which the gypsy can rotate relative to the shaft the locking lever being at all times resiliently biased to adopt the first position, the windlass additionally comprising a controlling means adapted to modulate the amount of friction to which rotation of the gypsy relative to the shaft is subject.

In this specification, the meanings of 'upper' and 'lower' correspond to the orientations in the figures which are designated as views from above or below.

The drive shaft may be linked to a manual or motorised drive of any convenient type.

The gypsy comprises a pair of jaws about which the anchor rode passes. Each jaw may be manufactured independently and the two jaws fixed together subsequently. Preferably the jaw portions are identical, for ease of manufacture. The gypsy has a central bore through which the drive shaft passes. The gypsy is rotatably mounted on the drive shaft.

The drive shaft may be shaped to limit the movement of the gypsy down the shaft, for example by means of a shoulder beyond which the gypsy cannot pass. Preferably, a lower member is positioned between gypsy and the shoulder. The lower member is preferably a tight press fit on shoulder of the drive shaft so that drive can be transmitted from the drive shaft to the lower member. The lower member contacts the gypsy and maintains the position of the gypsy on the drive shaft. Friction may be induced by this contact which opposes the rotation of the gypsy relative to the drive shaft and the lower member.

The lower member is preferably cone-shaped. The conical surface of this cone-shaped lower member may then be received into a correspondingly tapering recess in the lower surface of the gypsy.

The upper surface of the gypsy preferably comprises a gypsy lock which may be secured to the upper surface of the gypsy by any convenient means, for example welding, or, alternatively, it may be an integral part of the gypsy. The gypsy lock is adapted so that it can be engaged by the locking lever. To this end, it may comprise one or more pockets which can receive a lower tooth of the locking lever. More preferably, two, three or four pockets may be employed. When the tooth is engaged in a pocket of the gypsy lock, rotation of the locking lever can drive the rotation of gypsy.

The locking lever may be pivotally mounted by any convenient means. It is shaped so that it can engage the gypsy lock. It is preferable that a tooth is located on a lower surface of the locking lever which can be received in a pocket on the upper surface of the gypsy lock. The pocket may be engaged by pivoting the locking lever and lowering the tooth.

The locking lever is urged towards a position in which the lower tooth can engage the pocket of the gypsy. This may be achieved by any convenient means but preferably a spring is used to urge the locking lever into the engaging position.

The controlling means which modulates the amount of friction to which rotation relative to the drive shaft may be subject, may comprise a friction zone positioned on the lower surface of the locking lever on the opposite side of the fulcrum from the tooth. This friction zone may comprise a rough surface. The friction zone may be shaped so as to comprise a protrusion which can be received by a correspondingly shaped groove in upper surface of the upper half of the gypsy. When the locking lever is pivoted so that it cannot engage the gypsy, the friction zone is consequently lowered so that it contacts the upper half of the gypsy and frictionally impedes rotation of the gypsy relative to the locking lever and the drive shaft. The extent of impedance is determined by the amount of pressure put on the locking lever. In this way, rotation of the gypsy may be controlled.

In preferred embodiments, the drive shaft transmits drive directly to the top cap. This may be achieved, for example, by the engagement of a splined region of the drive shaft with an internally splined bore of the top cap. It is preferable, in these embodiments, that the top cap transmits drive directly to the locking lever. This may be achieved for example by the engagement of the top cap with side walls of the locking lever. Gypsy rotation relative to the drive shaft may be controlled in these embodiments by the use of a friction zone on the locking lever.

It is preferable that the top cap allows the locking lever to be manipulated so that the assembly can be switched between the drive and free fall modes. The top cap may comprise an aperture in the top cap through which an elongate implement may act on the locking lever, for example by pushing down on it, so as to disengage it from the gypsy lock. The elongate implement may be part of a switch mechanism or may form part of a tool such as a handle or a plunger. When the implement ceases to act on the locking lever, the resilient action of spring will urge the locking lever back into a position where it can engage the gypsy lock, thereby preventing rotation of the gypsy relative to the drive shaft.

The aperture and the implement may be shaped so as to prevent the rotation of the implement within the aperture, for example, both may be splined. This allows the implement to be used as a handle to tighten and loosen the top cap in those embodiments in which rotation of the top cap controls the amount of friction on the rotation of the gypsy during 'free-fall'.

In embodiments in which a friction zone is situated on the locking lever, the elongate implement may be used to apply pressure on the locking lever and thereby control rotation of the gypsy relative to the drive shaft.

An upper member may contact the upper half of the gypsy. In a less preferred embodiment, this upper member is driven by the drive shaft. In these embodiments, drive is transmitted to the upper member by the engagement of a region of the drive shaft with a bore of the upper member. This engagement may be facilitated by splines on one or more of the engaging surfaces.

In embodiments in which drive is transmitted to an upper member, the upper member is shaped so that it can engage the locking lever and drive it. In these embodiments, the upper member may have one or more pockets which can receive the lower tooth of the locking lever and preferably the upper member has two, three or four pockets. When the tooth is engaged in a pocket of the upper member, rotation of the upper member drives the rotation of locking lever. When the tooth is also engaged in a pocket of the gypsy lock, drive can be transmitted from the upper member, through the locking lever to the gypsy.

Friction induced by the contact between the upper member and the gypsy impedes rotation of the gypsy relative to the upper member. The amount of friction induced may be controlled by increasing the pressure exerted by the upper member on the gypsy.

The upper member may be cone-shaped, in which case the conical surface of this cone-shaped upper member is preferably received in a correspondingly tapered recess in the upper surface of the gypsy.

In embodiments in which an upper member is driven by the drive shaft, it is preferable that the tooth may also be received into a pocket in the upper member, so that the tooth can simultaneously engage both the upper member and the gypsy.

In this case, the controlling means may comprise a top cap engaged on a externally threaded terminal region of the drive shaft. Rotation of the top cap will adjust its position along the drive shaft, and, because the drive shaft is shaped to limit the downward movement of the windlass components, this will alter the pressure on the upper and lower members. The greater the pressure on the members, the greater the frictional engagement between the members and the gypsy and the more difficult it is for the gypsy to rotate relative to the drive shaft.

During operation, the anchor rode is paid out, when the anchor is dropped, by switching the windlass assembly to a free-fall mode, in which the gypsy-can rotate on the drive shaft. This switching is carried out by pivoting the locking lever so that it disengages the gypsy lock. The rotation of the gypsy and hence the free fall of the anchor can then be controlled by altering the frictional resistance using the controlling means.

When the anchor rode is hauled in, the locking lever is urged by the spring into engagement with the gypsy. In embodiments in which the locking lever is driven directly by the top cap, the locking lever will itself rotate with the drive shaft, engage the gypsy lock within one revolution or less and then transmit drive to the gypsy. Alternatively, in embodiments which an upper member is driven, this will rotate with the drive shaft and engage the locking lever within one revolution. The upper member will then drive the locking lever so that it engages the gypsy lock within one further revolution. Drive can then be transmitted to the gypsy.

Figure 1:
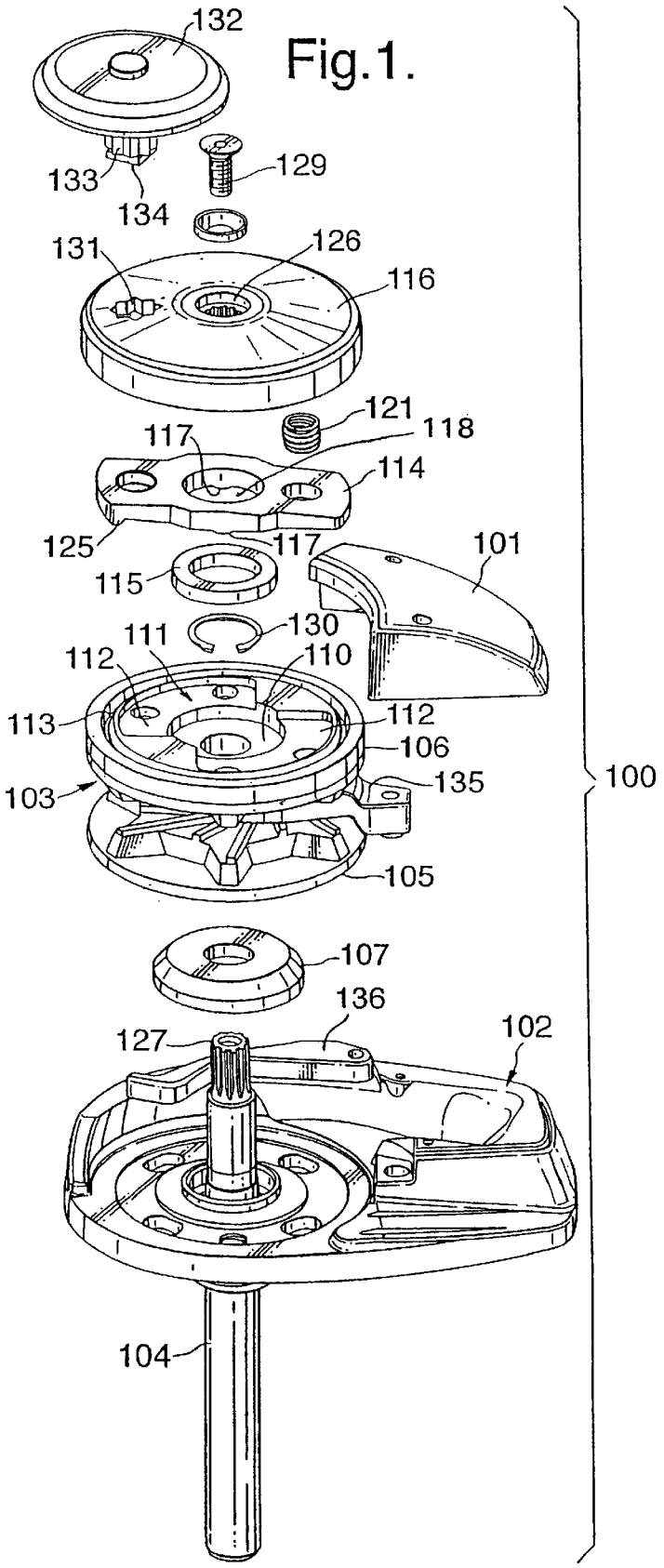
FIG. 1 shows an exploded perspective of a first embodiment of the present invention from below.
Figure 2:
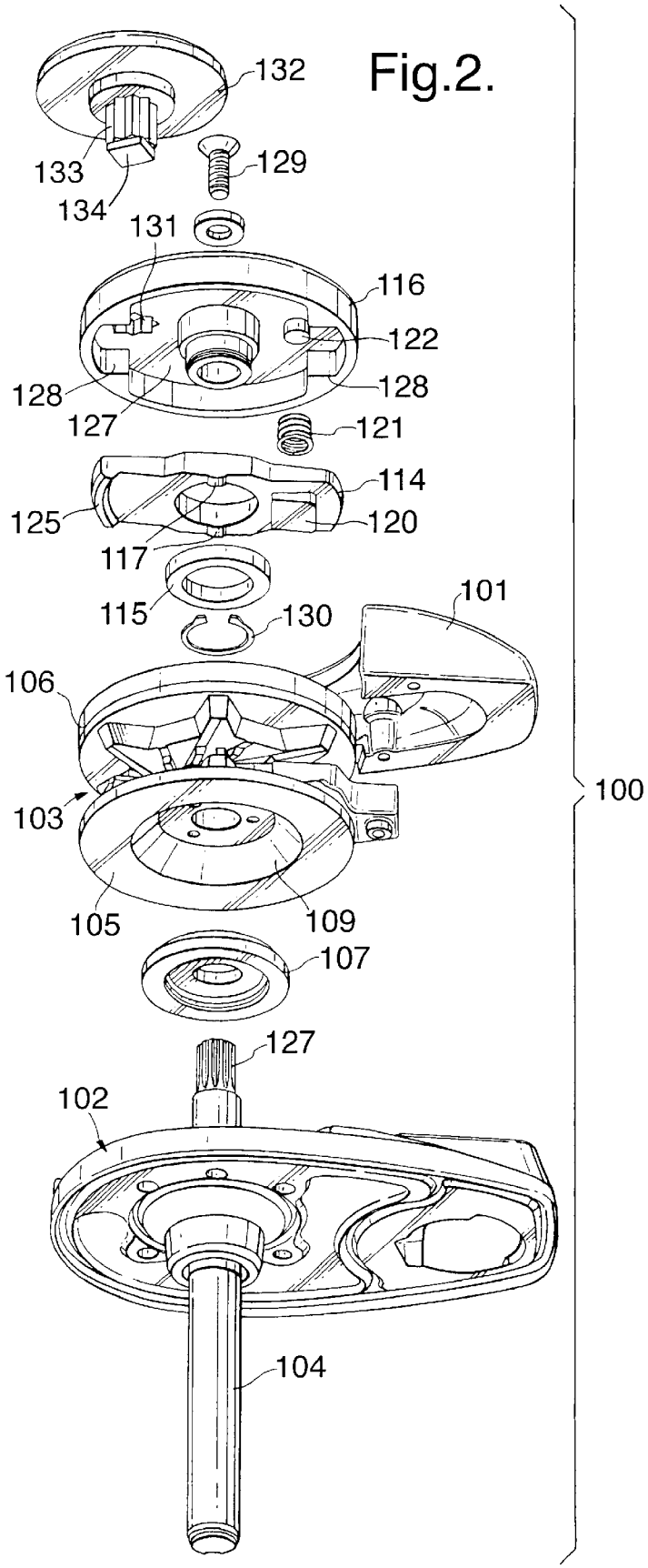
FIG. 2 shows an exploded perspective of the first embodiment of the invention from above.
Figure 3:
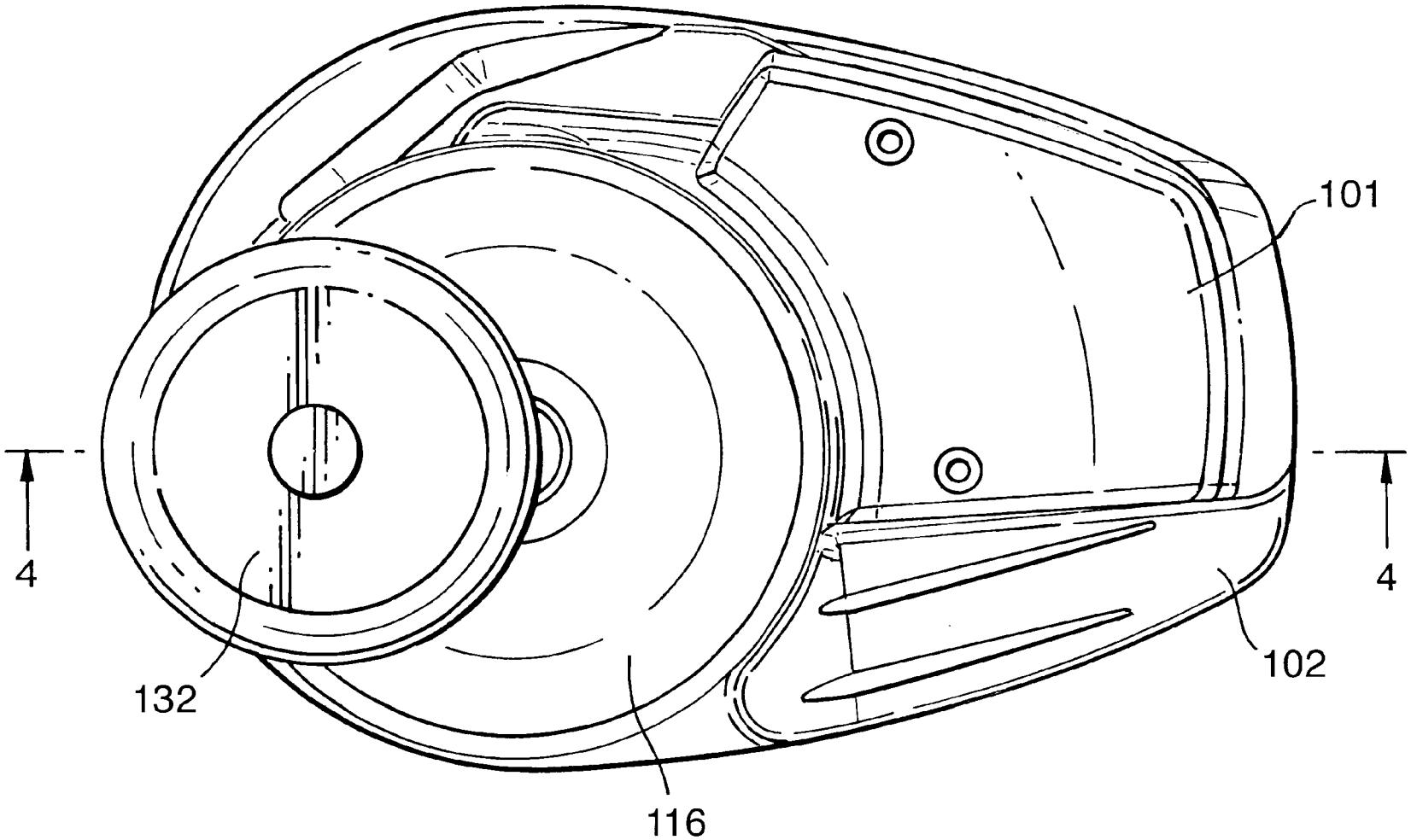
FIG. 3 shows a top view of the first embodiment assembled.
Figure 4:
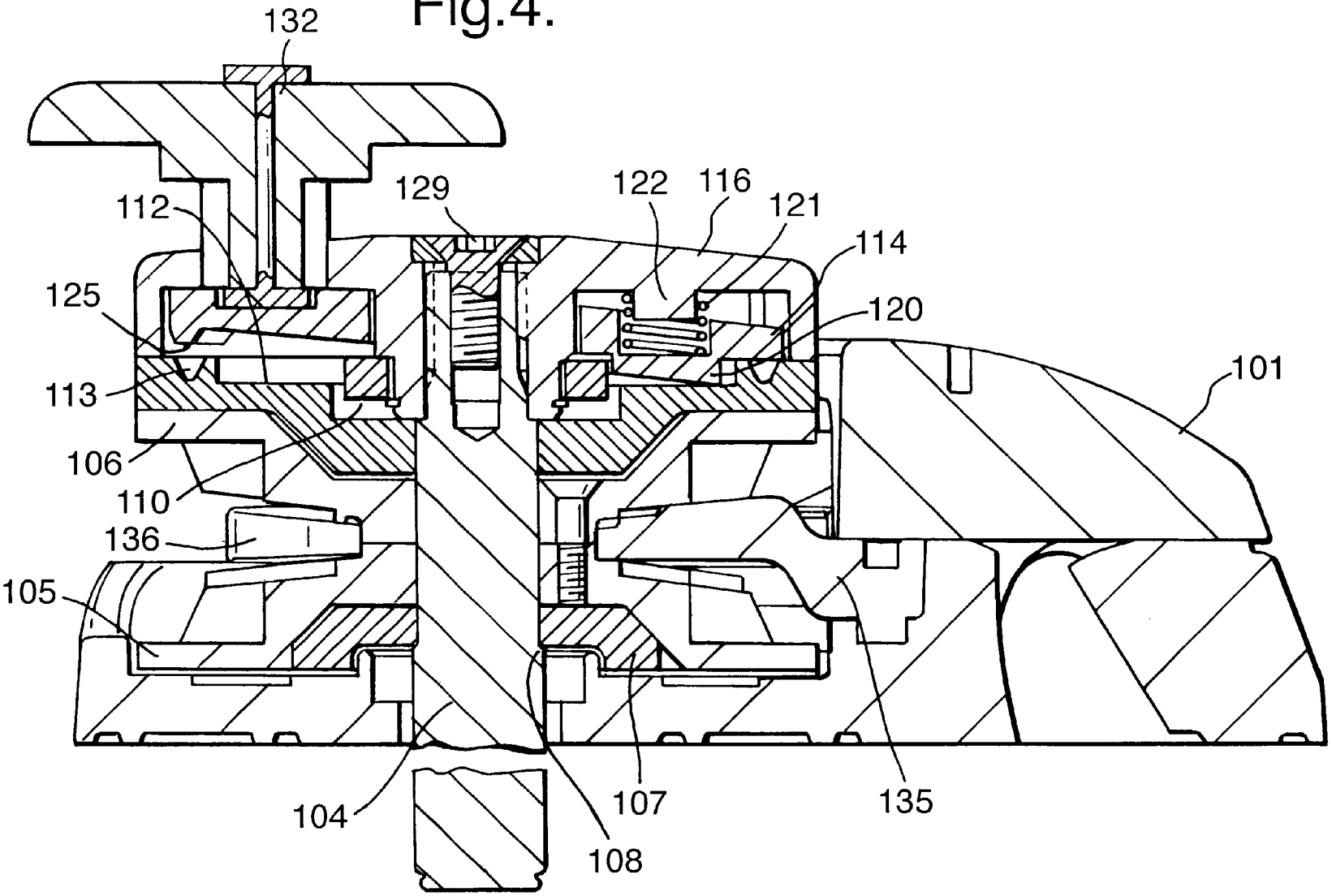
FIG. 4 is a section on the plane 4—4 of FIG. 3.
Figure 5:
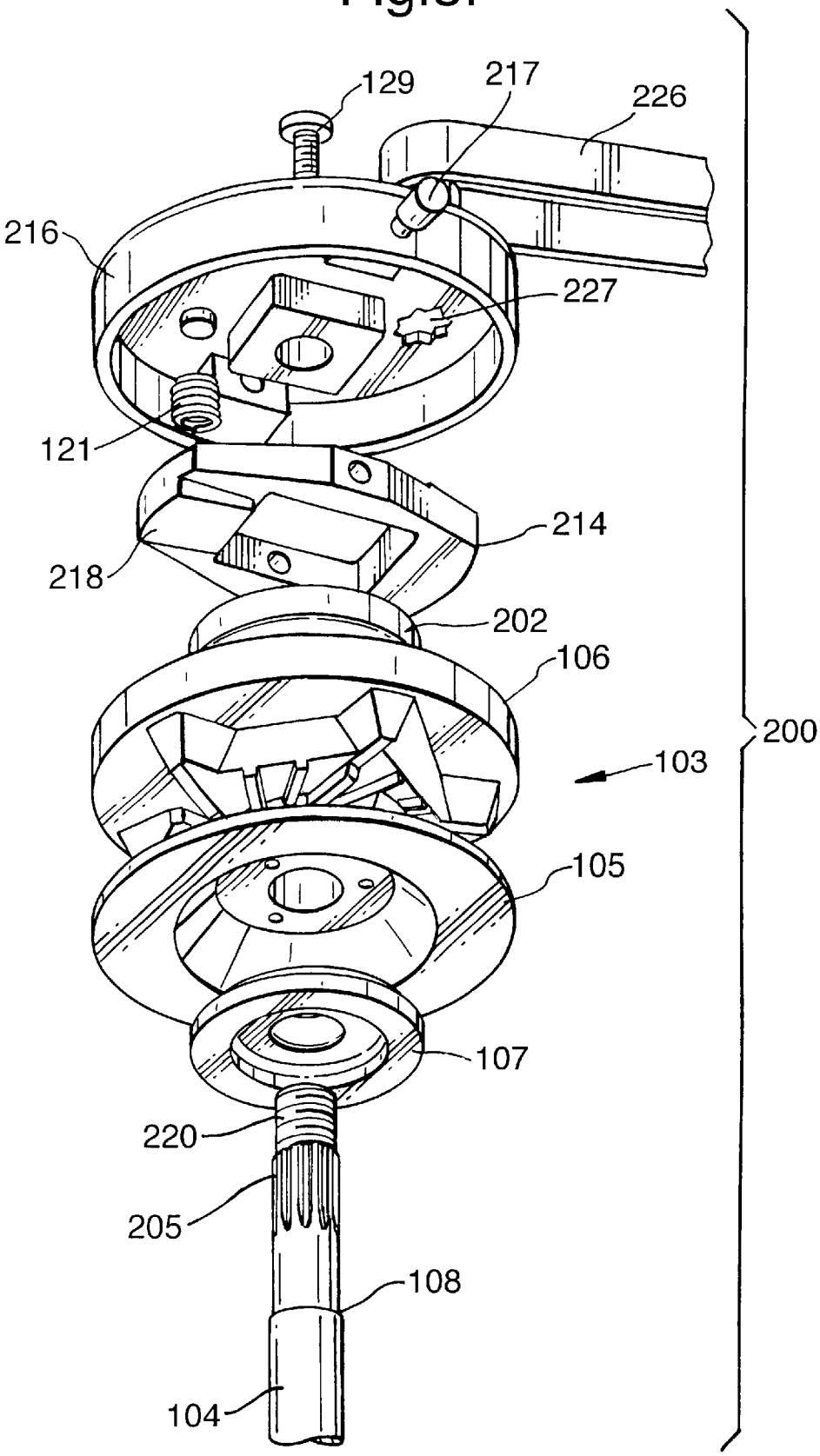
FIG. 5 shows an exploded perspective of a second embodiment of the invention from below.
Figure 6:
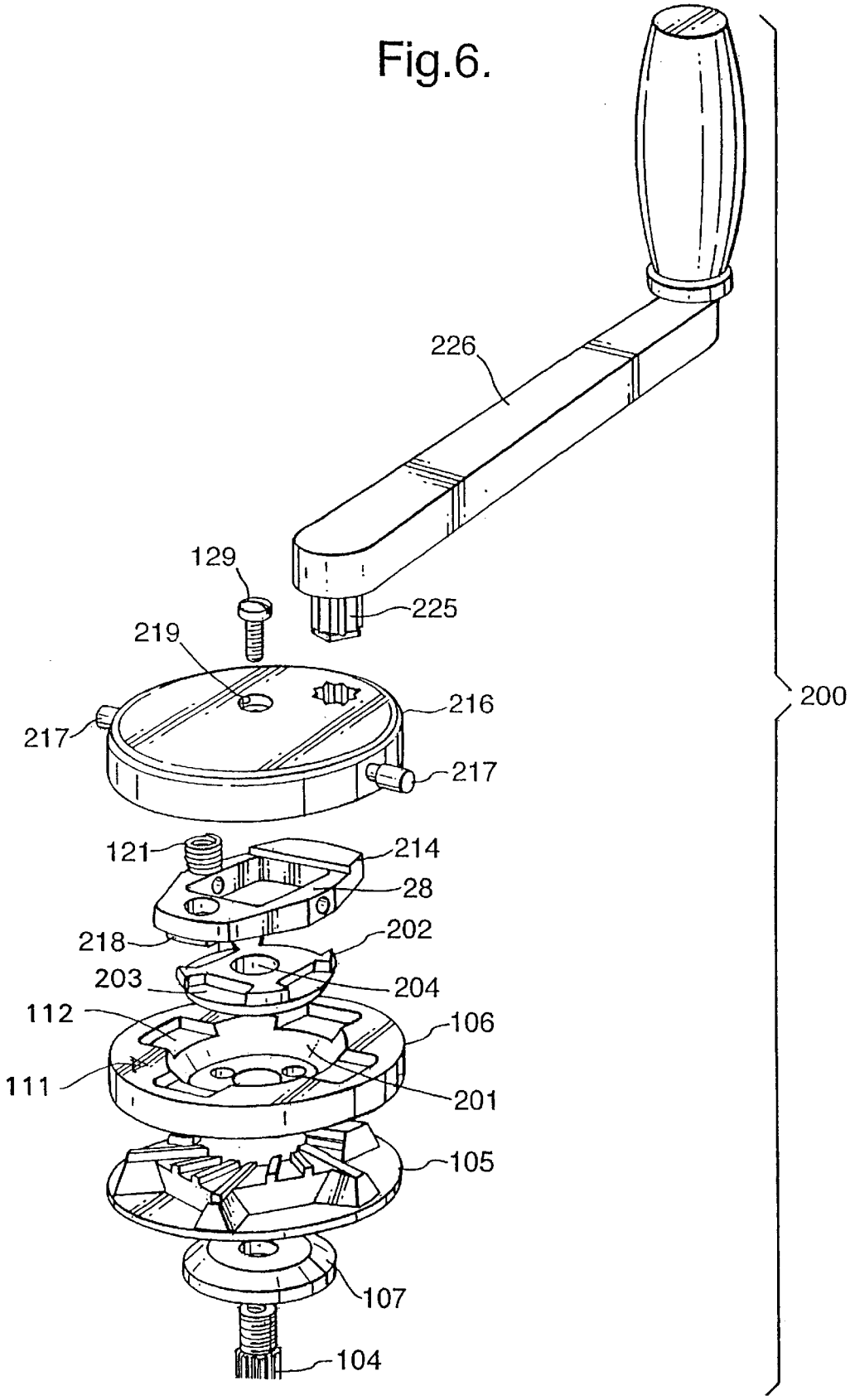
FIG. 6 shows an exploded perspective of the second embodiment of the invention from above.

The preferred embodiment of windlass 100 is shown in FIGS. 1 to 4. A casing 101 encloses a gypsy 103 and other working parts to be described, and covers a base 102 for mounting on a deck and which defines a reversible inlet and outlet for a rope or chain (or rope and chain successively) from the anchor to make a single turn of about 180° around the gypsy. The other reversible inlet and outlet is a hole in the base 102 through which the rope and/or chain passes to a storage locker below the deck.

The gypsy 103 is borne on a rotatable drive shaft 104, the lower end of which is keyed for the transmission of drive to it. The gypsy has two jaws, provided here by separate gypsy halves 105,106, fixed together by three screws (not shown) but the two jaws could be provided by a one piece pulley-like part. The jaws offer between them a radially inwardly tapering groove which is for receiving and gripping the rope and/or chain of an anchor rode and are appropriately shaped, both in known fashion. The drive shaft 104 passes through a central bore in the halves 105, 106 without rotational engagement with them.

A lower cone 107 is press-fitted onto the drive shaft 104 by means of a smooth central bore to abut against a shoulder 108 on the shaft and be permanently locked to the shaft. The conical surface of the lower cone 107 is received into a correspondingly tapering recess 109 in the lower gypsy half 105. The upper gypsy half 106 has a recess 110, which receives part of a top cap and retainer ring, to be described. A gypsy lock portion 111 is formed integrally in the upper gypsy half 106, or could be a separate part secured there. Pockets 112 are located in the upper surface of the gypsy lock 111. A groove 113 runs around the upper surface of the gypsy lock 111, describing a circle with the axis of rotation of the gypsy at its centre.

A locking lever 114 is located between the retaining ring 115 and a top cap 116. The locking lever 114 has two rounded protrusions 117 on its lower surfaces, diametrically of the bore 118 through which the shaft 104 passes. The locking lever 114 contacts the retaining ring 115 through these protrusions 117, which are aligned to define a fulcrum about which the locking lever 114 is free to pivot. The locking lever 114 has a tooth 120 on its lower surface which can engage a pocket 112 in the gypsy lock 111. A spring 121, retained on a stud 122 on the top cap to be positioned between the top cap 116 and the locking lever 114, urges the tooth 120 at all times to engage the pocket 112. An arcuate protrusion 125 formed on the lower surface of the locking lever 114 on the opposite side of the fulcrum from the tooth 120. The protrusion 125 is received in the correspondingly shaped groove 113 in the upper surface of the gypsy lock when the locking lever 114 is appropriately pivoted against the urging of the spring 121. Contact between the protrusion 125 and the groove 113 induces increased frictional interaction between the gypsy and the lower cone 107 which is fast with the shaft, when the gypsy rotates relative to the locking lever 114.

The top cap 116 has a splined bore 126 to receive a splined end portion 127 of the drive shaft 104. The top cap 116 thereby rotates at all times with the drive shaft 104. The top cap has a deep recess 127 in its lower surface, side walls of pockets 128 of which engage both sides of the locking lever 114 at all times. This engagement couples the top cap 116 to locking lever 114. The top cap 116 is fixed to the drive shaft by a restraining bolt 129, and the retaining ring 115 by a circlip 130.

An aperture 131 is located in top cap 116 so that a plunger 132 operable using a hand or a foot, can through its stem 133 contact the locking lever 114. The aperture 131 and stem 133 are of bi-square section and the stem is securable in the aperture by rotation of a square plate 134 out of alignment with the recesses of the aperture 131. The contact of the stem on the locking lever pushes down on one side of the locking lever 114 against the force of the spring 121, causing the lever 114 to pivot about the fulcrum defined by the protrusions 117. This disengages the lower tooth 120 of the locking lever 114 from the pocket 112 of the gypsy lock 111. In this position, the gypsy 103 is disengaged from the drive shaft 104 and is capable of 'free fall'.

Increasing the pressure on the protrusion 125, by increasing the downward force applied to the locking lever 114 by the plunger 132, increases the amount of friction induced by the contact between the protrusion 125 and the groove 113. This impedes the free rotation of the gypsy and allows the 'free fall' of the gypsy to be controlled.

When pressure on the plunger 132 is released, further rotation of the gypsy will cause the pockets 112 in the gypsy lock 111 to align with the tooth 120 and this, under the urging of the spring 121, will achieve lock. Similarly, whenever the drive shaft 104 is rotated, unless the plunger is deliberately and forcibly depressed, the tooth 120 of the locking lever 114 will align one of the pockets 112 in the gypsy lock 111 and achieve drive.

Anchor rode passing around the gypsy 103 is stripped by stripper arm 135 secured to the base plate 102 by entrapment between it and the casing 101.

Arm 136 presses the anchor rode into the taper between the jaws of the gypsy so as to maintain drivable engagement on it even when there is no load on the line or chain of the rode.

In a second embodiment 200, like parts are given the same numbering as in the first embodiment. However, in contrast to the first embodiment, the upper gypsy half 106 has a conically tapering recess 201, which receives face-to-face the conical surface of a top cone 202. The top cone 202 has four pockets 203 on its upper surface and has a splined bore 204 to receive a splined section 205 of the drive shaft 104 upon which it can move axially. A gypsy lock 111 is formed integrally with the upper gypsy half 106. Pockets 112, here four of them, are formed on the upper surface of the gypsy lock 111.

A locking lever 214 is connected to a top cap 216 by pivot pins 217. The locking lever 214 is free to rotate about the axis defined by the pins 217 and which is diametrical of the top cap 216 and the shaft 104. It has a lower tooth 218, which can simultaneously engage a pair of pockets 112,203 in both the top cone 202 and gypsy lock 111 so as to transmit drive from the shaft 104 via the cone 202 to the gypsy half 106. A spring 121, positioned between the top cap 216 and the locking lever 214, urges the lower tooth 218 into engagement with the pockets 112, 203.

The top cap 216 has an internally threaded recess 219 to receive a threaded end portion 220 of the drive shaft 104 so that the position of the top cap 216 along the drive shaft 104 can be adjusted by rotation relative to the drive shaft 104. Because the lower cone 107 abuts against the shoulder 108 on the drive shaft 104, pressure on the cones 202, 107 can be changed by tightening or loosening the top cap 216 via the thread on the end portion 220 of the drive shaft 104. The greater the pressure on the cones 202, 107 the greater the frictional engagement between the recess 201 and the conical surface of the top cone 202 and the less easily the gypsy 103 can rotate relative to the shaft. The top cap 216 is prevented from unscrewing completely from the drive shaft 104 by the restraining bolt 129.

A stem 225 of a handle 226 can be inserted into an aperture 227 in the top cap 216 to contact and push down on the locking lever 214 at its side opposite to the tooth 218. This contact causes the locking lever 214 to pivot on the fulcrum of the pivot pins 217 against the force of the spring 121, so that the tooth 218 disengages from the pockets 112,203 in both the top cone and gypsy lock. The drive to the gypsy is then disconnected and it can rotate on the shaft. However, the frictional resistance to the free rotation of the gypsy and hence free fall of the anchor can be controlled by the setting of the top cap 216.

In ordinary hauling of the anchor rode, the drive shaft 104 is rotated and the splined section 205 of the drive shaft 104, which engages the top cone 202 through the splined bore 204, transmits the drive to the top cone 202. In the absence of downward pressure on the handle 226 the lower tooth 218 of the locking lever 214 is urged by the spring 121 into engagement with the pockets 112, 203. Drive from the top cone 202 is transmitted via the locking lever 214 to the gypsy lock 111. Because the gypsy lock 111 is part of (or may be secured to) the upper gypsy half 106, this drives the gypsy.

When the anchor rode is to be paid out, the handle stem 225 is inserted into the aperture 227. Pressure from this disengages the tooth 218 of the locking lever 214 from the pockets 112, 203 so that the gypsy can rotate freely, subject to controllable frictional restraint as described above.

Even if the top cap 216 is loose and/or the windlass was left in its free fall condition, it is possible to haul the anchor rode (unless the handle stem 225 is actively pressed downwardly). When the drive shaft 104 is rotated, the top cone 202 will rotate with the drive shaft 104. A pocket 203 in the top cone 202 will engage the tooth 218 of the locking lever 214 under the urging of the spring 121. Further rotation of the top cone 202 and the engaged tooth 218 will, within a quarter of a revolution, further engage into a pocket 112 of the gypsy lock 111. This will supply drive to the gypsy 103.

The same applies if the gypsy tends to pay out a line or chain when it should not; the tooth 218 of the lever 214 will tend to enter into the pockets and lock the gypsy relative to the shaft.

What is claimed is:

1. A windlass having a rotatable drive shaft bearing a gypsy, adapted for receiving a line and/or chain, a locking lever movable between a first position in which the gypsy is coupled to the drive shaft and a second position in which the gypsy can rotate relative to the shaft, the locking lever being at all times resiliently biased to adopt the first position, and the windlass additionally comprising a controlling means adapted to modulate the amount of friction to which rotation of the gypsy relative to the shaft is subject.

2. A windlass having a rotatable drive shaft bearing a gypsy, adapted for receiving a line and/or chain, a locking lever movable between a first position in which the gypsy is coupled to the drive shaft and a second position in which the gypsy can rotate relative to the shaft, the locking lever being biased to adopt the first position, and the windlass additionally comprising a controlling means adapted to modulate the amount of friction to which rotation of the gypsy relative to the shaft is subject, wherein drive shaft rotation is transmitted to a member having one or more pockets which receive a tooth of the locking lever in the said first position, the tooth also then being engaged in a pocket of the gypsy such that drive is transmitted from the member, through the locking lever to the gypsy.

3. A windlass having a rotatable drive shaft bearing a gypsy, adapted for receiving a line and/or chain, a locking lever movable between a first position in which the gypsy is coupled to the drive shaft and a second position in which the gypsy can rotate relative to the shaft, the locking lever being biased to adopt the first position, and the windlass additionally comprising a controlling means adapted to modulate the amount of friction to which rotation of the gypsy relative to the shaft is subject, wherein a top cap is at all times constrained to rotate with the shaft and bears the locking lever in rotation whereby transmission in the first position of the lever is from the top cap via the lever to the gypsy.

4. A windlass according to claim 3, wherein there is an aperture in the top cap, an implement passing through that aperture, the implement capable of acting on the locking lever so as to disengage it from its first position, and of exerting on the lever to controlledly modulate the friction to which rotation of the gypsy relative to the shaft is subject.

5. A windlass according to claim 4 wherein the lever is at all times received in a pocket in the top cap whereby rotational thrust is transmissible between side walls of the pocket and side walls of the lever.

6. A windlass according to claim 3 wherein the lever is at all times received in a pocket in the top cap whereby rotational thrust is transmissible between side walls of the pocket and side walls of the lever.

7. A windlass according to claim 3 wherein the locking lever pivots about an axis between its first and second positions and has a tooth on one side of its axis of pivot for engagement with a pocket of the gypsy in the first position to couple rotationally to the gypsy, and at the other side of the axis of pivot provides said controlling means by bearing down on said gypsy without rotational coupling therewith.

8. A windlass according to claim 7 wherein there is an aperture in the top cap, an implement passing through that aperture, the implement capable of acting on the locking lever so as to disengage it from its first position, and to cause said bearing down.

9. A windlass having a rotatable drive shaft bearing a gypsy, adapted for receiving a line and/or chain, a locking lever movable between a first position in which the gypsy is coupled to the drive shaft and a second position in which the gypsy can rotate relative to the shaft, the locking lever being biased to adopt the first position, and the windlass additionally comprising a controlling means adapted to modulate the amount of friction to which rotation of the gypsy relative to the shaft is subject, wherein the lever is pivoted in a top cap which is screw-threadedly engaged with the shaft, axial displacement of the top cap controlledly modulating the friction to which rotation of the gypsy relative to the shaft is subjected.

* * * * *